US008148923B2

(12) United States Patent
Alimov et al.

(10) Patent No.: US 8,148,923 B2
(45) Date of Patent: Apr. 3, 2012

(54) METHOD FOR ACCELERATING ELECTRONS IN A LINEAR ACCELERATOR AND AN ACCELERATING STRUCTURE FOR CARRYING OUT SAID METHOD

(75) Inventors: Andrei Sergeevich Alimov, Moscow (RU); Boris Sarkisovich Ishkhanov, Moscow (RU); Nikolai Ivanovich Pakhomov, Moscow (RU); Viktor Petrovich Sakharov, Moscow (RU); Vasily Ivanovich Shvedunov, Moscow (RU)

(73) Assignees: Obschestvo S Ogranichennoi Otvetstvennostyu 'Nauka I Tekhnologii, Moscow (RU); Federalnoe Gosudarstvennoe Uchrezhdenie 'Federalnoe Agentstvo PO Pravovoi Zaschite Resultatov Intellektualnoi Deyatelnosti Voennogo, Spetsialnogo I Dvoinogo Naznachenia'Pri Ministertve Yustitsii Rossiyskoy Federatsii, Moscow (RU); Nauchno-Issledovatelski Institut Yadernoi Fiziki Imeni D.V. Skobeltsina Moskovskogo Gosudarstennogo Universiteta Imeni M.V. Lomonosova, Moscow (RU)

( * ) Notice: Subject to any disclaimer, the term of this patent is extended or adjusted under 35 U.S.C. 154(b) by 334 days.

(21) Appl. No.: 12/451,434

(22) PCT Filed: Dec. 12, 2005

(86) PCT No.: PCT/RU2005/000635

§ 371 (c)(1),
(2), (4) Date: Nov. 12, 2009

(87) PCT Pub. No.: WO2007/069930

PCT Pub. Date: Jun. 21, 2007

(65) Prior Publication Data

US 2010/0207553 A1 Aug. 19, 2010

(51) Int. Cl.
*H05H 9/00* (2006.01)

(52) U.S. Cl. ..... 315/505

(58) Field of Classification Search ..... 315/505
See application file for complete search history.

(56) References Cited

U.S. PATENT DOCUMENTS 5,532,210 A * 7/1996 Shen ..... 505/200

* cited by examiner

*Primary Examiner* — Jacob Y Choi
*Assistant Examiner* — Henry Luong
(74) *Attorney, Agent, or Firm* — James Creighton Wray

(57) ABSTRACT

Low-injection energy electrons are accelerated in a continuous standing wave linear accelerator. Electron flow is supplied directly from a low-energy electron source to subsequent sequential accelerating units interconnected via connection cells. By grouping electrons in the first bunch resonator at a determined gap voltage, increasing the electron energy in a booster resonator and accelerating the electron energy in the accelerating unit, the optimal phase of particles with respect to the electromagnetic field is ensured. The length of each accelerating structure segment, which is located between centers of the adjacent cells, is based on the equality between the relation of the length of each following segment to the length of the previous segment and the relation of the average electron speed in the previous segment to the average electron speed in the following segment.

5 Claims, 4 Drawing Sheets

METHOD FOR ACCELERATING ELECTRONS IN A LINEAR ACCELERATOR AND AN ACCELERATING STRUCTURE FOR CARRYING OUT SAID METHOD

This application claims the benefit of PCT/RU2005/000635 filed Dec. 12, 2005, which is hereby incorporated by reference in its entirety.

FIELD OF IMPLEMENTATION

This invention relates to the area of physics, in particular, to process of low-injection energy electrons acceleration in a continuous linear accelerator, i.e. to accelerating structures of linear electron accelerator with standing wave operated in continuous mode.

PRIOR ART

High-voltage electron bunches are widely used not only for scientific and applied researches, but also for solution of environmental tasks, as well as in industry for development of new material-processing technologies for acquisition of new properties or disposal of hazardous wastes from different producing operations. Development of new technologies requires the increase of electron bunch permeability, i.e., electron energy increase, as well as increase of average bunch power.

Until recently, in the area of energies up to 5 MeV direct accelerators based on high-voltage transformer or cascade generators, and in the area of energies up to 10 MeV more compact pulse linear accelerators having significantly lower bunch power were the basic source of electrons with high bunch power.

Use of direct electron accelerators in most technological processes is complicated due to big dimensions of accelerators, which require specially equipped premises and limit formation of local radiation shielding, as well as due to necessity of using expensive insulation gas under high pressure to reduce probability of high-voltage breakdown.

From the other hand, in the area of energies up to 5 MeV bunch power of pulse linear accelerators is several times lesser than bunch power of direct linear accelerators.

Accordingly, its is actual to develop continuous linear accelerators, in particular, those with standing wave, combining compactness and high average bunch power at the absence of voltages (both high-frequent and constant) increasing several tens of kilovolts.

However, when realizing the concept of continuous linear accelerator, some specific problems arise due to low, approx. 1 MeV/m, rate of energy increase limited by permissible level of thermal loads of accelerating structure and acceleration efficiency requirements. In particular, the following problems arise.

(1) It is known that in the range of wavelengths 10-12 cm, the increase of electron energy in continuous linear accelerator after transmission through one accelerating unit is 30-60 keV, whereupon electron velocity is close to light velocity only after transmission of 10 units and above. That's why, in order to provide electron synchronization with accelerating field of the length of accelerating units, where electrons velocity slightly differs from light velocity (electrons energy is higher than the rest energy equal to 0.511 MeV), should be selected according to definite rules considering the increase of particles' velocity.

(2) It is known that in accelerating structures with standing wave, used for electrons acceleration, the length of accelerating unit can not be less than the quarter of accelerating field length. Therefore, the length of injected particles, $v_0$, should be close to half of light velocity c (relative velocity $\beta_0=v_0/c\geqq 0.4\div 0.5$), which corresponds to high injection energy exceeding 70-80 keV.

(3) It is known that in order to increase high ratio of particles capture in linear accelerator they should be previously grouped. To provide effective grouping, definite ratio should be maintained between energy modulation amplitude in bunch resonator and the length of drift segment, at which particles are grouped into bunches; the higher is particles energy, the greater should be absolute energy modulation value or the length of drift segment. In order to prevent degrouping in the course of acceleration, the energy modulation amplitude should be significantly lower than particles energy increase per unit. Generally, modulation amplitude for continuous electrons accelerator doesn't exceed 5 keV. That's why, 0.5-1 m long drift segment between bunch resonator and accelerating structure is needed at high injection energy, which significantly increases accelerator's dimensions.

If external bunch resonator is absent, parameters of linear accelerator with standing wave, such as injection energy, portion of injected bunch current caught into acceleration mode, power of bunch current losses at the walls of accelerating structure and on cathode of electron gun, dimensions, bunch divergence and output energy distribution are specified by characteristics of starting part of an accelerator providing formation of electron bunches from continuous non-relativistic bunch of electron gun, as well as their focusing and acceleration up to relativistic energy.

Different accelerating structures for linear accelerators are known.

E.g., accelerating structure for linear accelerator (U.S. Pat. No. 4,160,189, B1) is known. It contains, at least:

accelerating section formed by chain of resonators and operated in standing wave mode;

additional section with resonators located underneath the accelerating section on the way of mentioned particles flow, linked and connected to accelerating section by electromagnetic field; meanwhile, specified resonators of accelerating section having holes on the axis for bunch transmission, are connected to each other by electromagnetic field; and a device for transmission of microwave signal into accelerating section;

In the meantime, the additional section contains, at least, first resonator and second resonator, interconnected by electromagnetic field. The second resonator has such length L that the distance D separating the interaction of first resonator of additional section and second resonator of accelerating section is specified by some ratio; the second resonator of additional section with selected dimensions is interconnected with the first resonator of additional section by electromagnetic field, and with the first resonator of accelerating section in such a way that microwave field is zero in the second resonator of additional section.

This accelerating structure is distinguished by the presence of resonator, which can function as buncher representing the integral whole with accelerating structure. However, one can use the proposed approach only for pulse linear accelerators with high rate of energy increase and high injection energy, as far as this patent by no means defines the selection of resonator parameters for accelerating structure located in front of drift segment formed, by second non-excited resonator, also functioning as communication resonator. Usual accelerating structure with standing wave is not able to provide the capture of low-energy bunch from continuous mode to accelerating mode. Besides this, modulated electronic stream in the second resonator with significant volume and, therefore, with high soundness, will excite radiated electromagnetic field of significant amplitude, which will adversely impact onto the bunch.

Continuous linear accelerator with low velocity of injected particles (U.S. Pat. No. 5,744,919, A) is known. It contains, at least:

a source of charged particles providing the stream of charged particles with velocities lower than minimal velocity of injected particles, necessary for effective acceleration in high-frequency linear accelerator without drift tubes;

first linear accelerator with one or more resonators, each with drift tube within, adopted for acquisition of charged particles from particle source, and for particles acceleration from initial velocity, which they have, when entering the resonator, up to minimal velocity needed for effective acceleration in linear accelerator without drift tubes;

second linear accelerator with one or more resonators, not having drift tubes, adopted for particles acquisition from the first linear accelerator and for acceleration thereof up to relativistic velocity;

microwave energy source connected to first and second linear accelerators so that it excites $TM_{010}$ oscillation within;

connecting structure linking the mentioned microwave energy in the first accelerator and the second accelerator, so that they provide phase shift, at which charged particles going from the first mentioned accelerator, enter in the first resonator of the second mentioned accelerator in the time, when electric field of mentioned $TM_{010}$ oscillation in the first resonator of second accelerator is oriented so that it accelerates the mentioned particles.

The task specified for this linear accelerator envisages the capture of electrons with low initial velocity into acceleration mode at $\beta_0 \geqq 0.1 \div 0.2$, in continuous linear accelerator.

However, firstly, it is known that affixtures of drift tubes installed in accelerating resonators lead to significant reduction of their soundness, which increases microwave power losses and structure heating. Secondly, affixtures' presence leads to asymmetry occurrence in electromagnetic field distribution against the axis of accelerator, which adversely impacts onto lateral movement of flow-energy bunch. Thirdly, the analogue has no elements, which could provide particles grouping. These disadvantages increase current losses in transit channels, thereby limiting the achievable bunch power and increasing the radiation background of accelerator and reducing the accelerator's effectiveness.

There is known the method of electrons acceleration with high injection energy and continuous linear electron accelerator with standing way (A. S. Alimov, K. A. Gudkov, D. I. Yermakov, PTE No. 5, 1994, pgs 7-22), containing the electron source fed from high-voltage power supply, and accelerating structure and connecting structure in between, where electron bunch is grouped by external resonator fed from microwave power source using regulatory carrier link. Thereupon, grouped electron bunch is focused by lens and accelerated in accelerating units, which length is growing in proportion to increase of accelerated particle velocity. Meantime, supply voltage is fed from high-voltage rectifier to electron source and microwave power source.

However, in order to get powerful electron bunch at rectifier output at high, between 80-100 keV, injection energy, the power of injected bunch should be 5-10 kW, from which, at least, the half is lost in transit channel of accelerator, thereby limiting the achievable bunch power and increasing the radiation background of accelerator and reducing the accelerator's effectiveness. Meantime, separate high-voltage rectifier is needed for electron gun supply. Besides this, the presence of standalone bunch resonator significantly increases the accelerator's dimensions and complicates high-voltage supply system.

DISCLOSURE OF INVENTION

The aim of this invention is the achievement of effective acceleration of electrons with low initial energy (with initial relative velocity $\beta_0 \approx 0.2$) increase of electron capture in continuous linear electron accelerator with standing wave without using the exterior bunch resonator.

When creating this invention, the task was set to develop the way of accelerating electrons with low initial energy by consistent electrons grouping directly in accelerating structure and acceleration thereof in accelerating structure with definite configuration under high-frequency electromagnetic field providing required output characteristics of electronic bunch. There was also set a task to create accelerating structure for performing this method of low-injection energy electrons acceleration.

The set task was solved by development of the method of low-injection energy electrons acceleration in continuous linear accelerator with standing wave, including consistent electrons grouping and acceleration thereof in high-frequency electromagnetic field formed in accelerating units, where the following operations are performed:

supply of electron stream directly from low-energy electron source to subsequently accelerating units via connection units;

electrons grouping by first accelerating unit operating as bunch resonator, at the voltage $U_g$ on its gap selected from the following ratio:

$$\frac{U_g}{U_0} \approx \frac{7.36}{\pi(4n-1)},$$

Where $U_0$ is the voltage of electrons, n=1, 2, 3 . . . ;

increase of electron energy from the second accelerating unit working as booster resonator, so that their relative velocity becomes $\beta \geqq 0.4 \div 0.5$, and, meantime, ensuring of optimal grouping based on electrons velocity at the input of bunch resonator, and wavelength of high-frequency electromagnetic field by selection of the distance $L_g$ between gap centers of bunch resonator and booster resonator based on the following ratio:

$$\frac{L_g}{\beta_0} = \frac{4n-1}{4}\lambda \text{ , where } \beta_0 = v_0/c,$$

Where $v_0$ is velocity of electron stream at the input into bunch resonator, c is light velocity, λ Is microwave field wavelength in free space, n=1, 2, 3 . . . ; and increase of electron energy up to required values in following units after the second accelerating unit; meantime, optimal particles phase is ensured with respect to electromagnetic field in, at least, accelerating units, to which non-relativistic electrons enter with kinetic energy less than rest energy equal to 0.511 MeV. This is provided by selecting the length $L_i$ of the accelerating structure, which is located between the centers of adjacent connection units and comprising the said accelerating structure, provided that the length of each following segment in accelerating structure located between the centers of adjacent connection units and comprising the said structure, relates to that in previous segment, as average electron velocity in the previous segment relates to that in the following segment.

Meantime, according to this invention, it is reasonable that electron energy in accelerating units following the those providing kinetic energy exceeding the rest energy, is increased in groups of specified segments with equal length; meantime, the length of individual segment in group and quantity of such segments were selected based on the condition, that phase shift of accelerated particle with respect to accelerating field after its passage in a group of segments, doesn't exceed $10^0$.

The set task was also solved by creation of a structure for acceleration of electrons with low initial energy in constant linear accelerator with standing wave comprising successively accelerating units, adopted for formation of electromagnetic field under the source of high-frequency power, where each previous accelerating unit is connected to the following accelerating unit by coupling slots through interior or side connection cell, and at the same time:

first accelerating unit is bunch resonator adopted for direct communication with the source of low initial energy, second accelerating structure is booster resonator, adopted for increasing of incoming electrons energy up to the values providing their acceleration in the successive part of accelerating structure, the distance Lg between the gap centers of bunch resonator and booster resonator is selected according to velocity $v_0$ of electron stream at the input to bunch resonator and microwave field wavelength $\lambda$ of high-frequency source in free space based on the following relation:

$$\frac{L_g}{\beta_0} = \frac{4n-1}{4}\lambda,$$

where $\beta_0 = v_0/c$, c is light velocity and n=1, 2, 3 . . . , units following after the second accelerating unit are adopted for energy increase in entering electrons up to required value and, at least, for accelerating units, to which non-relativistic electrons enter with kinetic energy less than rest energy, provided the length of each following segment in accelerating structure located between the centers of adjacent connection units and comprising the said structure, relates to that in previous segment, as average electron velocity in the previous segment relates to that in the following segment. Meanwhile, according to this invention, it is reasonable that accelerating units following the accelerating units adopted for increasing the kinetic energy of electrons in excess of the rest energy, are adopted for further energy increase; meantime, the specified segments of accelerating structure have equal length, and the length of individual segment in group and quantity of such segments were selected based on the condition, that phase shift of accelerated particle with respect to accelerating field after its passage in a group of segments doesn't exceed $10^0$.

Meanwhile, according to this invention, it is reasonable that accelerating units are connected to each other through internal or side connection units.

Therefore, when creating this invention, the task of increasing the electrons with low initial energy was solved in definitely formed high-frequency electromagnetic field of accelerating unit, providing the desired modes of electrons grouping and acceleration.

BRIEF DESCRIPTION OF DRAWINGS

The invention is further clarified by description of invention implementation examples and attached drawings, at which.

Meantime, represented examples of acceleration of low-energy injection electrons and described versions of accelerating structures operation according to the invention don't go beyond this invention and don't limit the possibility of invention implementation.

BEST VERSION OF INVENTION IMPLEMENTATION

According to the invention the method of acceleration the electrons with low injection energy can be implemented, e.g., by acceleration unit as per the invention. This unit is represented on FIG. 1 and FIG. 2 for internal and side connection units, respectively.

Figure 1:
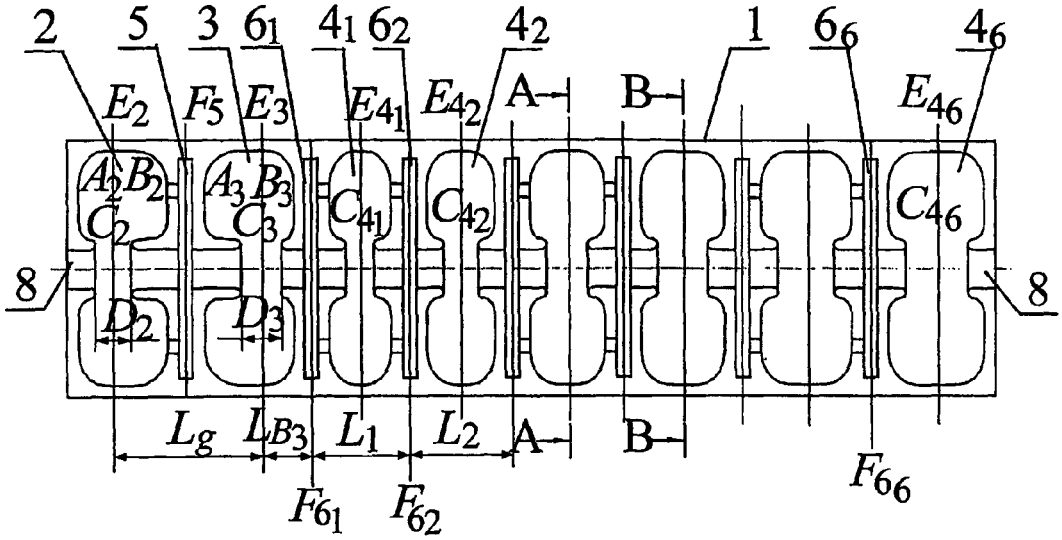
FIG. 1—diagram of accelerating structure with internal connection units as per the invention.
Figure 1A:
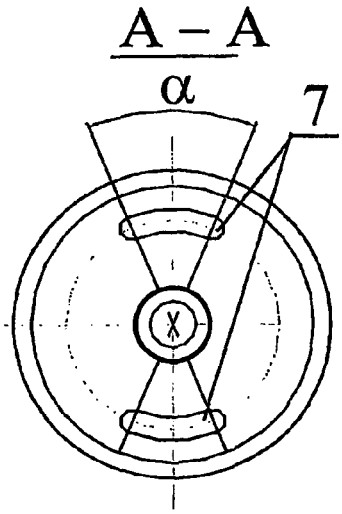
FIG. 1*a*—accelerating unit $\mathbf{4}_3$ of accelerating structure shown at FIG. 1, section A-A at gap center.
Figure 1B:
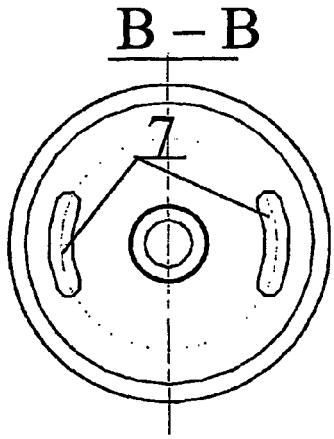
FIG. 1*b*—accelerating unit $\mathbf{4}_4$ of accelerating structure shown at FIG. 1, section B-B at gap center.
Figure 2:
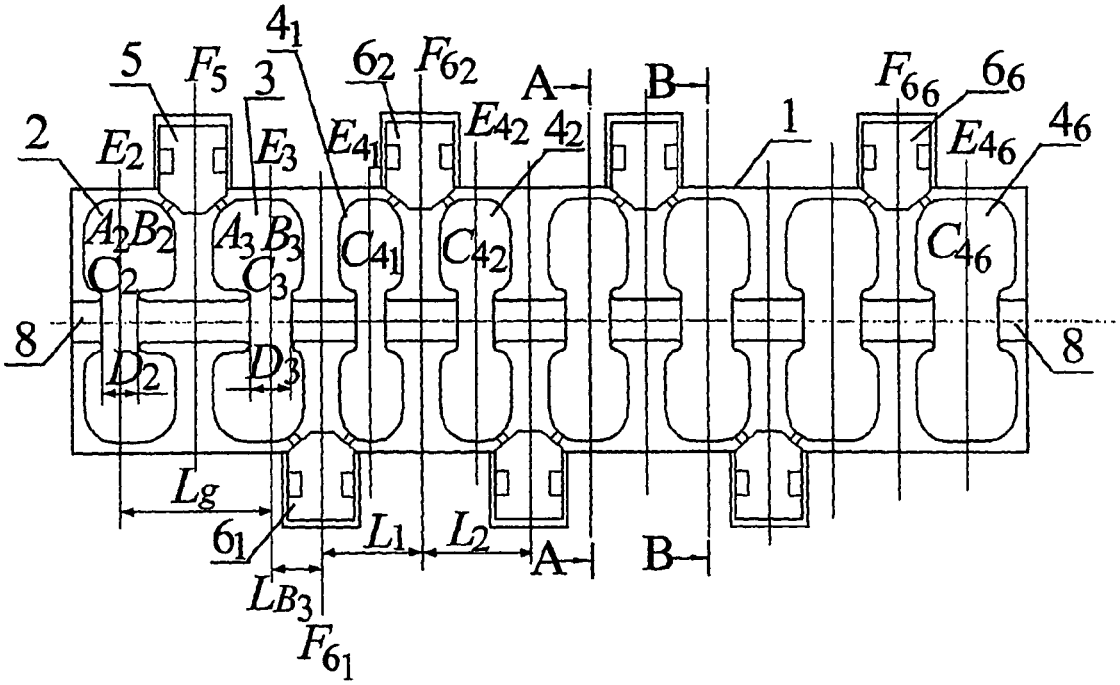
FIG. 2—diagram of accelerating structure with side connection units as per the invention.
Figure 2A:
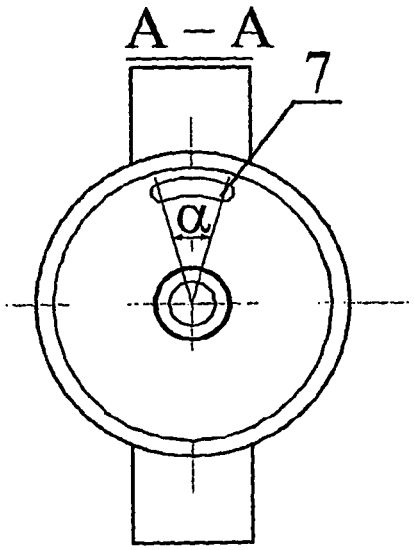
FIG. 2*a*—accelerating unit $\mathbf{4}_3$ of accelerating structure shown at FIG. 1, section A-A at gap center.
Figure 2B:
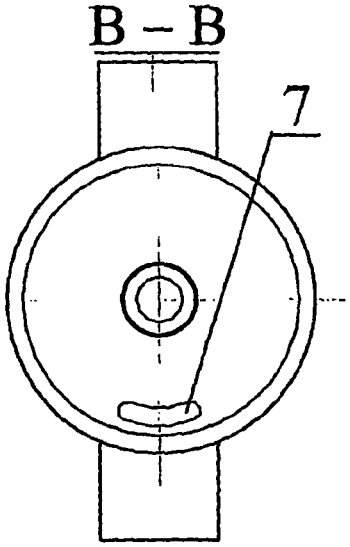
FIG. 2*b*—accelerating unit $\mathbf{4}_4$ of accelerating structure shown at FIG. 1, section B-B at gap center.

According to the invention, accelerating structure (FIG. 1, FIG. 1*a*, FIG. 1*b*, FIG. 1, FIG. 2*a*, FIG. 2*b*) contains accelerating units communicated via successive connection units, with first accelerating unit representing the bunch resonator 2, and second accelerating unit representing the booster resonator 3, as well as K successive accelerating units $\mathbf{4}_i$, i=1, . . . , K—e.g. as shown on the FIG. 1 at K=6.

Accelerating units 2 and 3 are interconnected via connection cell 5 by coupling slots 7.

Accelerating units 3 and $\mathbf{4}_1$ are interconnected via connection cell $\mathbf{6}_1$, and accelerating units $\mathbf{4}_i$ and are interconnected by connection units $\mathbf{6}_{i+1}$ at i=1, . . . , (K−1). Meantime, connection units $\mathbf{6}_1$ and $\mathbf{6}_{i+1}$ may be internal, e.g., as is shown on FIG. 1, or side ones, as is shown FIG. 2.

Meantime, previous side connection cell is located with relation to the following cell with 180° shift.

Meantime, in accelerating structure with internal accelerating units (FIG. 1), in order to reduce the influence of lateral components of electromagnetic field on the axis, as arises due to coupling slotting, by means of accelerated bunch dynamics, its reasonable that in accelerating units of slots pair on opposite walls are located diametrically and turned in connection units at the angle of 90°. In accelerating structure with side connection units (FIG. 2) one slot is located at each wall of accelerating structure; coupling slots at opposite walls are turned at the angle of 180° according to position of side connection units.

Channel 8 is located along the axis of accelerating structure 1 for passage of accelerated particles bunch.

Bunch resonator (FIG. 1, 2) is made of two parts; first of them $A_2$ and second $B_2$ have internal cavities facing towards each other and forming a common internal cavity $C_2$ of bunch resonator 2.

Booster resonator (FIG. 1, 2) is also made of two parts; first of them $A_3$ and second $B_3$ have internal cavities facing towards each other and forming a common internal cavity $C_3$ of booster resonator 3.

In order to provide maximal possibility of optimal gap width $D_2$ and resonators soundness $D_3$ and, thereby, reduction of high-frequency power losses for creation of grouping and accelerating fields, as well as to reduce thermal load and increase voltages on the gap $D_3$ of booster resonator 3, bunch resonator 2 and booster resonator 3 have internal cavities $C_2$ and $C_3$, respectively, which are asymmetric with relation to the centers $E_2$ and $E_3$ of accelerating gaps, $D^2$ and $D_3$, respectively, of bunch resonator 2 and booster resonator 3.

According to the invention, optimal distance $L_g$ between the gaps $E_2$ and $E_3$ and optimal voltage $U_g$ in the gap of bunch resonator should be selected in accelerating structure.

According to known theory of klystron grouping (I. V. Lebedev, Microwave apparatus and devices, $2^{nd}$ edition, Vol. 1 and 2. Moscow, 1970), when approaching infinitely narrow gap and neglecting the effects of charge cloud, the relation of amplitude of harmonically altered voltage $U_g$ at the gap of bunch resonator 2 (FIG. 1, 2) to the voltage $U_o$ of electron source, providing max. amplitude of circulating current first harmonic of at the distance $L_g$ from the center $E_2$ of gap $D_2$ of bunch resonator is given by the following relation:

$$\frac{U_g}{U_0} = \frac{x_1^1 \beta_0 \lambda}{\pi L_g}$$

where $x_1^1 \approx 1.84$ is position of the first maximum of first order Bessel function, $\lambda$ is microwave field wavelength in free space, $\beta_0 = v_0/c$, where $v_0$ is velocity of electron stream at the output of electrons source, and c is light velocity. Please note, that $$\beta_0 = \sqrt{1 - \left(\frac{em_0c^2}{em_0c^2 + U_0}\right)^2},$$

where $m_0$ is rest mass, and e is electron charge.

FIG. 3*a*, 3*b* show the graph of voltage change at the gap of bunch resonator 2 (FIG. 3*a*) and booster resonator 3 (FIG. 3*b*) for the version of accelerating structure according to the invention.

When plotting the graphs, it is considered that phase difference of accelerating field in adjacent units is equal to 180°.

It is known from the theory of klystron grouping that electrons are grouped into bunches with relation to electron passed the gap center of bunch resonator, when the sign of electromagnetic field changes from positive to negative one. That's why, in order to provide maximal factor of particles capture into acceleration mode electrons, passed the gap center $E_2$ of bunch resonator 2 at the change of accelerating field sign in the gap from positive to negative should pass the gap center $E_3$ of booster resonator 3 in the moment, when accelerating field has maximal negative value.

Straight lines on the FIGS. 3*a* and 3*b* show possible temporary relation between the moment of gap $E_3$ center passage of booster resonator 3. Therefore, minimal time interval between gap $E_2$ center passage of bunch resonator 2 and gap $E_3$ center passage of booster resonator 3 should be ¾ from accelerating field period. This interval can be increased multiple of microwave field period at the expense of the distance $L_g$ between gap centers $E_2$ and $E_3$. Therefore, the value of $L_g$ is defined by the following:

$$\frac{L_g}{\beta_0} = \frac{4n-1}{4}\lambda \tag{2}$$

where n=1, 2, 3 . . . specifies the number of integer periods minus one period of accelerating structure, during which the particles move between gap centers of bunch resonator 2 and booster resonator 3.

By substituting the expression (2) into expression (1), we will acquire:

$$\frac{U_g}{U_0} \approx \frac{7.36}{\pi(4n-1)} \tag{3}$$

Therefore, the ratios $$\frac{U_g}{U_0} \approx 0.781,\ 0.335,\ 0.213\ldots\ ,$$

respectively, and they don't depend on wavelength for any value of n=1, 2, 3 . . . .

Selection of n-value can be justified by following considerations.

As far as n-value increases, the distance $L_g$ between the centers $E_2$ and $E_3$ of gaps $D_2$ and $D_3$ of bunch resonator 2 and booster resonator 3, respectively, is also increased and voltage $U_0$ at the gap $D_2$ on bunch resonator is reduced.

The increase of $L_g$ enables to increase the volume and, hence, the stored energy and resonator soundness, but it results in increase of accelerating structure length, and increases the spurious fields, and complicates solution of bunch focusing problem and the settling process of accelerating structure.

In order to prevent particles de-grouping after passage of booster resonator 3, it is necessary to satisfy the condition $U_g \ll U_b$, where $U_b$ is the voltage across the gap of booster resonator 3.

However, providing of very low voltage across the gap of bunch resonator 2 may constitute a problem due to limited fabrication accuracy of accelerating structure and measuring of accelerating field distribution. Considering the above-stated, n=2 will be a compromising value.

All following accelerating units $\mathbf{4}_i$ are made symmetric about the centers of accelerating gaps $E_{4i}$, I=1, 2, . . . , K (FIG. 1, 2). To provide synchronization of accelerated particles with electromagnetic field, the particles should pass the distance from the center $E_{6i}$ of connection cell $\mathbf{6}_i$ up to the center $E_{6i+1}$ of connection cell $F_{6i+1}$ at a time equal to the half of accelerating field period t=T/2. This condition may be stated as follows:

$$\frac{L_i}{\bar{v}_i} = \frac{T}{2}, \quad (4)$$

where $L_i$ is the length of accelerating structure segment located between the centers of adjacent connection units, including accelerating unit $\mathbf{4}_i$; $v_i$ is average particles velocity within the specified segment of accelerating structure; i=1, 2, . . . K. This condition may be stated as follows:

$$\frac{L_{i+1}}{L_i} = \frac{\bar{v}_i}{\bar{v}_{i+1}}, \quad (5)$$

i.e., the length of each following specified segment of accelerating structure relates to that for the previous segment of accelerating structure, as the average electron velocity at the previous segment relates to that at the following segment.

As far as kinetic energy of accelerated particles grows, and they approach to light velocity, the length of specified segment, as it can be seen from the formula (4), approaches to the half of accelerating field wavelength. If kinetic energy of the particles exceeds the rest energy, than the difference of adjacent segments' lengths becomes insignificant and, in order to simplify the accelerating structure fabrication and reduce its cost, it is reasonable to group individual segments with the same length. According to the invention, the length of individual segment in group and number of such segments are determined from such condition that phase shift of accelerating structure against accelerating field after segment group passage doesn't exceed $10^0$.

The length $L_{B3}$ of segment located between the center of booster resonator 2 and the center of connection cell 5 is selected from the condition of approximate time equality of particle movement across the quarter-period of specified segment of accelerating field:

$$\frac{L_{B_3}}{\bar{v}_{B_3}} \approx \frac{T}{4}, \quad (6)$$

where $v_{B3}$ is average particles velocity within specified segment.

As far as average particles velocities $v_i$, i=1, 2, . . . K, $v_{B3}$ in formulas (4)-(6) are not known in advance and they are the functions of target lengths $L_i$, i=1, 2, . . . K and $L_{B3}$, as well as they depend on relative electromagnetic field distribution between accelerating units and common field level in accelerating structure, the target lengths are defined using iteration procedure including numeric calculations of electrodynamic parameters of accelerating structures and bunch dynamics by well-known software according to known techniques described in publications (Vetrov A. A., Calculation of electrodynamic parameters and optical properties of accelerating structures in wide wavelengths range. Thesis for Cand. Sc. degree. Moscow. Research and Development Institute of Nuclear Physics, Moscow State University, 2005, 138 pgs.).

According to the formula (3), voltage magnitude across the gap of bunch resonator 2 (FIG. 1, 2) and voltage magnitude across the gap of booster resonator 3 (FIG. 1, 2), ensuring the increase of relative particles velocities up to $\beta \geqq 0.4 \div 0.5$, are achieved by selecting the angles of slots 7 openings as per known technique described in publications (Zverev B. V., Sobenin N. P. Electrodynamic parameters of accelerating resonators. Moscow, 1993, Energoatomizdat, 240 pgs.).

Figure 3:
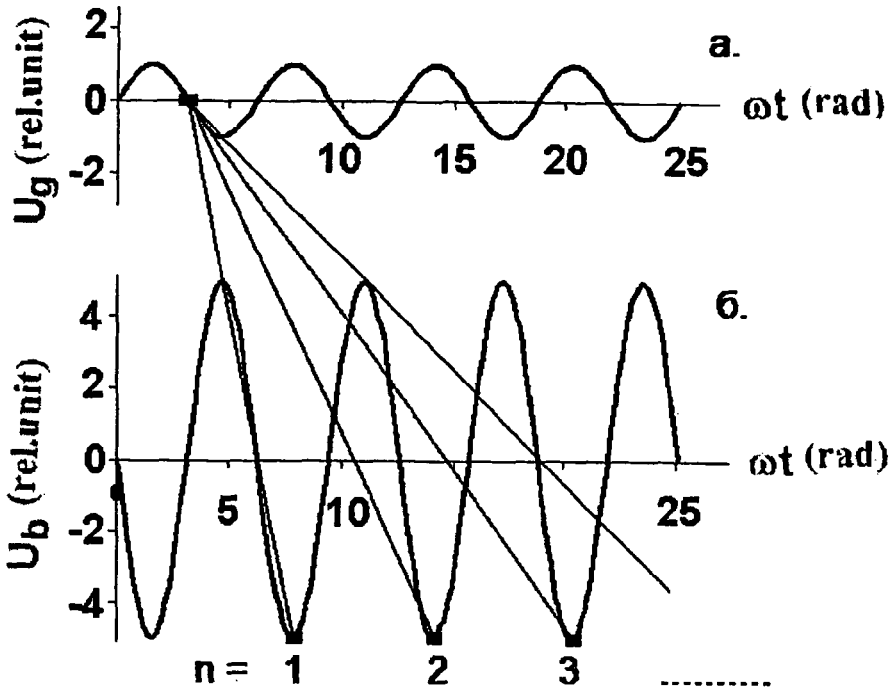
FIGS. 3*a* and 3*b*—graphs of voltage change at the gap of bunch resonator and booster resonator, respectively.
Figure 4:
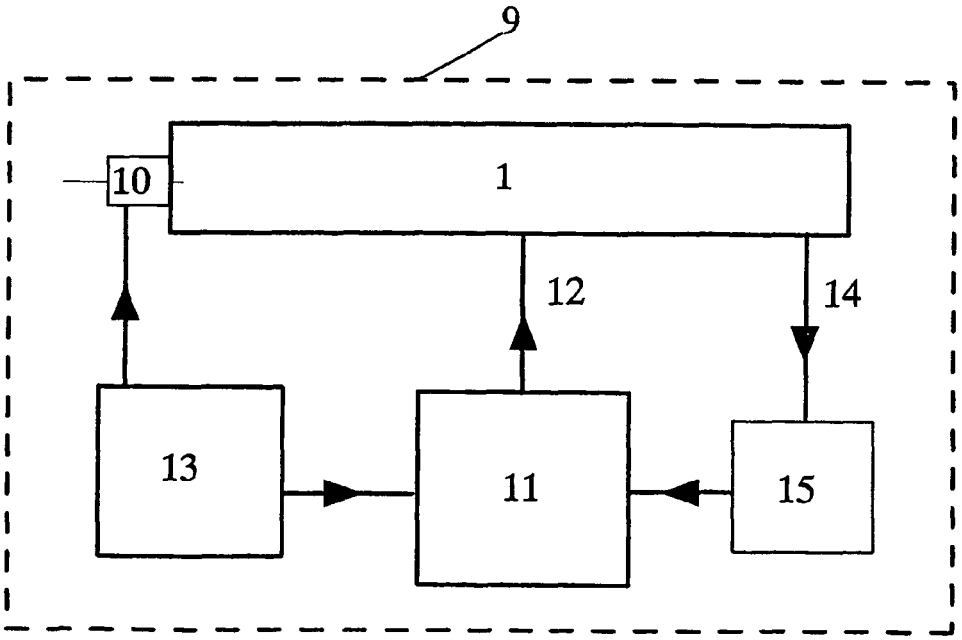
FIG. 4—diagram of constructive version of continuous linear accelerator with standing wave, comprising the accelerating structure as per the invention.

According to this invention, acceleration of electrons with low initial energy using the accelerating structure as described herein, may be illustrated in continuous linear accelerator with standing wave; refer to the version on FIG. 3.

Linear accelerator 9 (FIG. 3) contains: source of electrons with low energy, e.g., electron gun 10 installed directly onto the input of accelerating structure 1 fabricated according to this invention; high-frequency power source 11 for feeding of acceleration unit via wave-guide duct 12, high-voltage rectifier 13 for feeding of high-frequency power source 11 and electron gun 10.

Electron gun providing output electron bunch with energy of 10 to 20 keV can be used as electron gun 10.

Continuous klystron operated at 2450 MHz can be used as microwave power source.

Accelerator 9 also includes reception antenna 14 located in one of accelerating units, e.g., in cell 46 (FIG. 1, 2), and providing control of electromagnetic field parameters in accelerating structure 1.

Accelerator 9 also includes the device 15 for controlling the high-frequency power source 11; composition and function of this device are defined by individual implementation of high-frequency feeding system.

As per this invention, the accelerating structure 1 has different number of accelerating units and connection units with different geometric characteristics based on selected parameters of accelerator.

Number and geometric characteristics of accelerating structures 2, 3 and $\mathbf{4}_i$, i=1, 2, . . . K, and units 5, $\mathbf{6}_i$ at i=1, 2, . . . K, and their operational mode will be optimized according to this invention in order to provide required energy and current of accelerated bunch at maximum capture factor.

Further, this invention is clarified by concrete examples of accelerating structure carrying out according to this invention and continuous linear accelerator with standing wave in order to accelerate electrons with low initial energy for different values of output bunch energy and power.

In examples of concrete realizations of linear accelerator, as is shown below, authors believe that due to selected angles of slots openings the accelerating structure is set, so that energy growth in booster resonator 3 and the following accelerating units will amount to $\Delta E_r$.

Let the power of high-frequency losses, used for accelerating field formation at the length of accelerating structure (if this length is equal to the half of accelerating field wavelength) segment located between the centers of connection units and including the accelerating unit, will be denoted as $P_r$.

Based on experimental data available (Shvedunov V. I., Development and fabrication of continuous linear electron accelerator—injector of slotted microtron. Thesis for Cand. Sc. degree. Moscow. Research and Development Institute of Nuclear Physics, Moscow State University. 1992. 350 pgs), in this case, if energy growth per a cell is constant, then high-frequency power used for accelerating field creation changes in inverse proportion to the length of specified segment of accelerating structure:

$$P_i = P_r\left(\frac{\lambda}{2L_i}\right)^2 \quad (7)$$

We consider that high-frequency power losses, used for accelerating field formation in booster resonator 3, are equal to Pr. We neglect high-frequency power losses in bunch resonator 2, as the voltage across its gap is less by and order in compare to the voltage across the gap of accelerating unit; respectively, high-frequency power losses for the field formation are 100 times less than power losses in other accelerating units.

We believe that wave-guide equipment for high-frequency input into accelerating structure for all cases is set so that we can neglect the power of reflected wave. Full power $P_{tot}$ used for bunch acceleration and accelerating field formation amounts to 90% from max. klystron power $P_{kl}$. The rest 10% include possible power losses in high-frequency duct and bunch power losses during acceleration at the expense of particles sedimentation on the walls of transit channel of accelerating structure.

In the mentioned assumptions bunch power at the output of accelerator, consisting of K accelerating units (bunch resonator 2 and booster resonator 3 are excluded), is equal to:

$$E_{out}=\Delta E_r(K+1)+U_0 \tag{8}$$

In the mentioned assumptions, high-frequency power used for accelerating field formation and dissipated over the walls of accelerating structure is defined as follows:

$$P_w = P_r\left(1+\frac{\lambda^2}{4}\sum_{i=1}^{K} L_i^{-2}\right) \tag{9}$$

Based on the formula (4) the length of i-$^{th}$ segment may be represented as follows:

$$L_i = \frac{\lambda}{2}\overline{\beta}_i \tag{10}$$

where $\overline{\beta}_i$ is average relative particle velocity within i-$^{th}$ segment. In turn:

$$\overline{\beta}_i = \frac{1}{2}\left\{\sqrt{1-\left(\frac{m_0c^2}{m_0c^2+U_0+i\Delta E_r}\right)^2}+\sqrt{1-\left(\frac{m_0c^2}{m_0c^2+U_0+(i+1)\Delta E_r}\right)^2}\right\} \tag{11}$$

$$i = 1, 2, \ldots K$$

Bunch power at the output of accelerating structure is $P_{out}=E_{out}\ I_{out}$, where $I_{out}$ is bunch current at the output of accelerating structure. Based on energy conservation law one can write:

$$P_{out}=P_{tot}-P_w \tag{12}$$

and, respectively:

$$I_{out} = \frac{P_{tot}-P_w}{E_{out}} \tag{13}$$

Electron efficiency of accelerator is equal to:

$$\eta = \frac{P_{out}}{P_{tot}} \tag{14}$$

Relations (2), (3), (7)-(14) were taken as calculation basis for concrete accelerator versions.

Parameters of concrete accelerator version are defined by microwave source parameters, bunch energy at the output of accelerator, energy growth per accelerating unit and electrodynamic parameters of accelerating structure, in particular, its effective shunt resistant.

When making calculations, it was assumed that a unit is fed from continuous klystron operated at 2450 MHz ($\lambda$=0.1224 m) with maximal power $P_{kl}$=50 kW and feed voltage 15 kV.

Supply voltage of electron gun was selected equal to klystron supply voltage, so that $U_0$=15 kV.

Number of integer periods of accelerating field, when a bunch passes between the centers of booster resonator and bunch resonator, was taken as n=2.

According to this invention, it follows from the formula (3) that $U_g$=5 kV, and from the formula (2) $L_g$=50.7 mm.

Based of wide design and experimental material, the authors have stated that effective shunt resistance $\Delta E_r$ of accelerating structure is such, that at Pr=1 kW $\Delta E_r$ is equal to 60 keV. (A. S. Alimov, K. A. Gudkov, D. I. Yermakov. PTE No. 5, 1994, pgs 7-22). At other values of $\Delta E_r$, the relation $P_r \sim \Delta E_r^2$ is satisfied.

Table 1 represents the values $P_w$, $P_{out}$, $I_{out}$, $\eta$, as well as the length L of accelerating structure and full number of K+2 accelerating structures (including bunch resonator 2 and booster resonator 3) for $\Delta E_r$=60 keV and 3 values of output power $E_{out}$. Similar values are represented in the Table 2 for $\Delta E_r$=40 keV.

TABLE 1

Parameters for 3 versions of accelerator for $\Delta E_r$ = 60 keV

| $E_{out}$, MeV | $P_w$, kW | $P_{out}$, kW | $I_{out}$, mA | $\eta$, % | L, m | K + 2 |
|---|---|---|---|---|---|---|
| 0.555 | 16.0 | 29.0 | 52.2 | 64.4 | 0.492 | 10 |
| 0.975 | 24.4 | 20.6 | 21.1 | 45.7 | 0.883 | 17 |
| 1.455 | 33.2 | 11.8 | 8.1 | 26.2 | 1.35 | 25 |

TABLE 2

Parameters for 3 versions of accelerator for $\Delta E_r$ = 40 keV

| $E_{out}$, MeV | $P_w$, kW | $P_{out}$, kW | $I_{out}$, mA | $\eta$, % | L, m | K + 2 |
|---|---|---|---|---|---|---|
| 0.575 | 11.8 | 33.2 | 57.8 | 73.8 | 0.718 | 15 |
| 0.975 | 17.1 | 27.9 | 28.6 | 62.1 | 1.278 | 25 |
| 1.455 | 23.4 | 21.6 | 14.4 | 48.0 | 2.038 | 38 |

Based on the formula (6) we assess: $L_{B_3}\approx$13.5 mm for $\Delta E_r$=60 keV and $L_{B_3}\approx$12.0 mm for $\Delta E_r$=40 keV.

Figure 5:
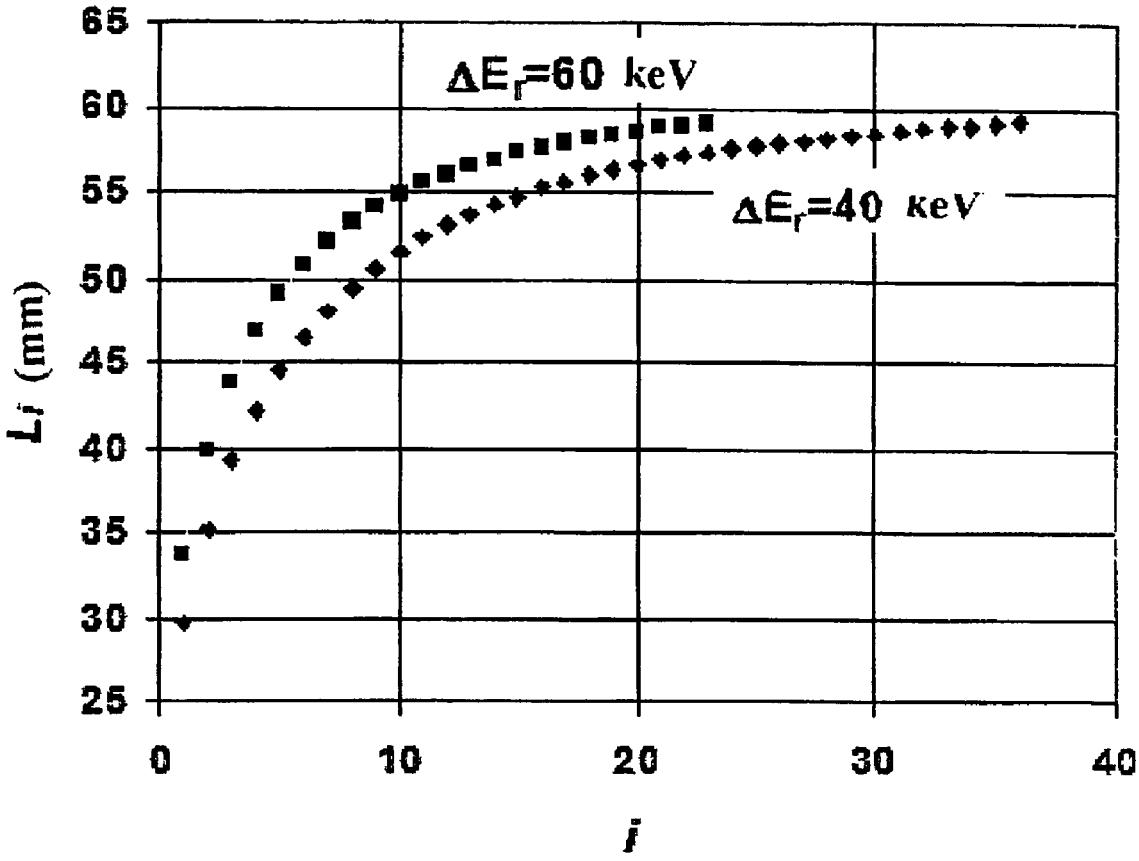
FIG. 5—dependence graphs of accelerating structure segment length form its number.

Dependences of the lengths of accelerating structure segments located between connection units and included accelerating unit from number of specified segment are shown on FIG. 5 for two considered versions of energy growth per cell.

The graphs (FIG. 5) show well the asymptotic approximation of optimal length of accelerating structure to the half of wavelength, as far as segment number increases.

Please note that considered version of accelerating structure with constant energy growth per cell is not the only one possible and it is selected in this case just because of simplicity of estimated calculations.

One may consider the versions with constant power of high-frequency losses in accelerating units and different combinations of thereof. In any case final selection of accelerating structure geometry for concrete application may be done only after detailed iteration calculations of electrodynamic characteristics of accelerating structure and bunch dynamics. Accelerating structure design may have several successively installed sections.

Application of this invention in continuous linear accelerators with standing wave enables to reach the following:

1. Electron gun bunch current losses are reduced in proportion to injection energy reduction and capture factor increase. E.g., the power of spurious losses reduces from 10 kW to 1 kW for process accelerator with average bunch power of 50-100 mA, i.e. reduces 10 times.

Power losses reduction diminish the heating of accelerating structure walls by electron bunch, whereby units' deformations also reduce and vacuum conditions improve, which increase service life of electron gun cathode and simplify vacuum system of accelerator.

Besides this, linear accelerator efficiency increases, as well as accelerating structure radiation background reduces, which diminish the mass of local radiation protection, if accelerator is installed in working premises.

2. Reduction of electron gun supply voltage up to the voltage of continuous microwave power source (10-30 kW depending on source type) enables to use one high-voltage rectifier for feeding both gun and source, which significantly reduces dimensions and cost and simplifies the diagram of high-voltage supply.

3. The use of bunch resonator within accelerating structure enables the installation of electron gun directly at the input of accelerating structure, which significantly reduces the length of linear accelerator. Besides this, reduction of electrons' supply voltage from 60-80 kV to 10-20 kV also enables to diminish dimensions of linear accelerator.

Therefore, when accelerating electrons with low initial energy in accelerating structure as per this invention, total reduction of accelerator length can be around 0.5 m, i.e., accelerator length for energy 0.5 MeV can be reduced nearly twice in compare to accelerator using the method of external grouping.

INDUSTRIAL APPLICABILITY

As per this invention, acceleration of electrons with low injection energy may be implemented in accelerating structures with different designs at different number of accelerating units providing the required particles acceleration parameters. Meanwhile, the accelerator design, including accelerating structure according to this invention, is able to vary both energetic and spatial parameters, which is important for accelerating structure selections as per this invention.

As per this invention, accelerating structures may be fabricated from known materials and devices using available know-how.

The invention claimed is:

1. Method for accelerating electrons in linear accelerator and an accelerating structure for carrying out of the said method, including successive electrons grouping and their acceleration in high-frequency electromagnetic field formed in accelerating units, where the following operations are performed:

electrons supply directly from the source of low-energy electrons into accelerating units communicated via connection cells;

where Ug is the optimal voltage electrons grouping using the first of accelerating units representing bunch resonator at the voltage $U_g$ on its gap selected from the formula:

$$\frac{U_g}{U_0} \approx \frac{7.36}{\pi(4n-1)}$$

where $U_0$ is the voltage of electron source, n=1, 2, 3, . . . .

where Lg is the distance between gap centers

Where βo is the initial relative velocity of low energy electrons increasing of electrons energy in the second of accelerating units representing booster resonator, so that their relative velocity becomes $\beta \geqq 0.4+0.5$; meantime, optimal grouping is provided as per the velocity of electron stream at the input of bunch resonator, and wavelength of high-frequency electromagnetic field is defined by selecting the distance $L_g$ between the centers of bunch resonator and booster resonator based on the following relation:

$$\frac{L_g}{\beta_0} = \frac{4n-1}{2}\lambda, \quad \text{where } \beta_0 = v_0/c$$

Where $v_0$ is velocity of electron stream at the input into bunch resonator, c is light velocity, λ is microwave field wavelength in free space, n=1, 2, 3 . . . ; and increase of electron energy up to required values in the units following after the second accelerating unit; meantime, ensuring of optimal particles phase with respect to electromagnetic field in, at least, accelerating units, to which non-relativistic electrons enter with kinetic energy less than a rest energy equal to 0.511 MeV electron energies, by selecting the length $L_i$ length of accelerating segment of the accelerating structure, which is located between the centers of adjacent connection units and comprising the said accelerating structure, provided that the length of each following segment in accelerating structure located between the centers of adjacent connection units and comprising the said structure, relates to that in previous segment, as average electron velocity in the previous segment relates to that in the following segment.

2. Method specified in cl. 1, further comprising that in accelerating units following those providing electrons kinetic energy exceeding the rest energy enables to increase electron energy in groups of specified segments with the same length; meantime, the length of individual segment in group and their number is selected from the condition, that phase shift of accelerated particle with respect to accelerating field after its passage in a group of segments, doesn't exceed $10^0$.

3. Accelerating structure (1) for electrons with low injection energy in continuous linear accelerator with standing wave, including successive accelerating units (2, 3, 4*i*) adopted for formation of electromagnetic field under the source of high-frequency power (11), where each previous accelerating unit is connected to the following accelerating unit by coupling slots (7) through connection cell (5, 6$_i$). At the same time:

first accelerating unit is bunch resonator (2) adopted for direct communication with the source (10) of electrons with low initial energy, second accelerating unit is booster resonator (3), adopted for increasing of incoming electrons energy up to the values providing their acceleration in the successive part of accelerating structure, the distance $L_g$ between the gap centers of bunch resonator (2) and booster resonator (3) is selected according to velocity $v_0$ of electron stream at the input to bunch resonator (2) and microwave field wavelength $\lambda$ of high-frequency source (11) in free space based on the following relation:

$$\frac{L_g}{\beta_0} = \frac{4n-1}{2}\lambda,$$

where $\beta_0 = v_0/c$, c is light velocity and n=1, 2, 3 . . . , units following after the second accelerating unit (4*i*) are adopted for increase of entering electrons energy up to required value and, at least, for accelerating units, to which non-relativistic electrons enter with kinetic energy less than a rest energy, Provided that the lengths (Li) of each following segment of accelerating structure, which is located between the centers (E2, E3, E41, . . . E4*i*) of adjacent connection units (5, 6*i*) and comprising the said accelerating structure, relates to that in previous segment, as average electron velocity in the previous segment relates to that in the following segment.

4. Method specified in cl. 3, further comprising that accelerating units following those adopted for kinetic energy increase above the rest energy, are adopted for further energy increase; meantime, individual segments of the same length (Li) compose groups, and the length of individual segment and number thereof is such, that phase shift of accelerated particle with respect to accelerating field after its passage in a group of segments doesn't exceed $10^0$.

5. Method specified in cl. 3, further comprising that accelerating units are communicated to each other via internal or side connection units (5, 6*i*).

* * * * *